United States Patent [19]

Tanabe

[11] 4,270,832

[45] Jun. 2, 1981

[54] PIN PLUG

[76] Inventor: Shigeru Tanabe, No. 3-10-15, Kita-Koiwa, Edogawa-ku, Tokyo, Japan

[21] Appl. No.: 33,315

[22] Filed: Apr. 25, 1979

[30] Foreign Application Priority Data

Oct. 23, 1978 [JP] Japan ..... 53/145688[U]

[51] Int. Cl.[3] ..... H01R 13/58

[52] U.S. Cl. ..... 339/105; 339/177 R

[58] Field of Search ..... 339/105, 177 R, 177 E, 339/182 R, 183

[56] References Cited

U.S. PATENT DOCUMENTS

| | | | |
|---|---|---|---|
| 2,050,440 | 8/1936 | McFadden | 339/105 |
| 3,031,637 | 4/1962 | Descarries | 339/105 |

FOREIGN PATENT DOCUMENTS

| | | | |
|---|---|---|---|
| 571910 | 3/1933 | Fed. Rep. of Germany | 339/105 |
| 780331 | 4/1935 | France | 339/105 |
| 858097 | 1/1961 | United Kingdom | 339/177 R |
| 904827 | 8/1962 | United Kingdom | 339/177 R |
| 1350087 | 4/1974 | United Kingdom | 339/177 R |

*Primary Examiner*—Neil Abrams

[57] ABSTRACT

There is disclosed a pin plug comprising a rod electrode and a cylindrical cap electrode encircling coaxially the rod electrode and a base body for supporting the rod electrode and the cap electrode. The base body includes a head section for supporting the bar electrode and a body section providing continuous axial and radial grooves for receiving the connecting cord with an annular space formed therebetween and with a stem portion coupling the head section with the body section.

5 Claims, 4 Drawing Figures

PIN PLUG

TECHNICAL FIELD OF INVENTION

This invention relates to a pin plug and more particularly to a connector for tightly connecting a connecting cord to a pin plug.

BACKGROUND ART

Various types of the pin plug have heretofore been commercially available and example of such the pin plug may be found in the Japanese utility model publications Nos. 45-16025, 51-41192, 53-50071 and 53-50070.

A problem of the prior pin plug heretofore used in the audio equipment for example is that a connection between the plug and the connecting cord is unstable and the latter is apt to disengage from the former or to cause a defective contact because the plug is usually disengaged from a jack by pulling the connecting cord.

SUMMARY OF THE INVENTION

With the foregoing in mind the inventor provides in accordance with the invention a pin plug in which the connecting cord is tightly fixed to a plug terminal without causing any deficiencies such as disengagement of the connecting cord from the electrode or defective contact therewith.

In the form of the invention herein disclosed the pin plug comprises a bar electrode, a base body for holding said bar electrode, a cap electrode coaxially and insulatedly encircling said bar electrode and a flexible sleeve for coating said base body wherein the base body is provided in its circumference with continuous axial and radial grooves for receiving a connecting cord to be connected to either the bar electrode or the cap electrode.

BRIEF DESCRIPTION OF THE DRAWINGS

Objects and attendant advantages of the invention will be apparent from the following disclosure taken in conjunction with the accompanying drawing wherein.

BEST MODE FOR CARRYING OUT THE INVENTION

Figure 1:
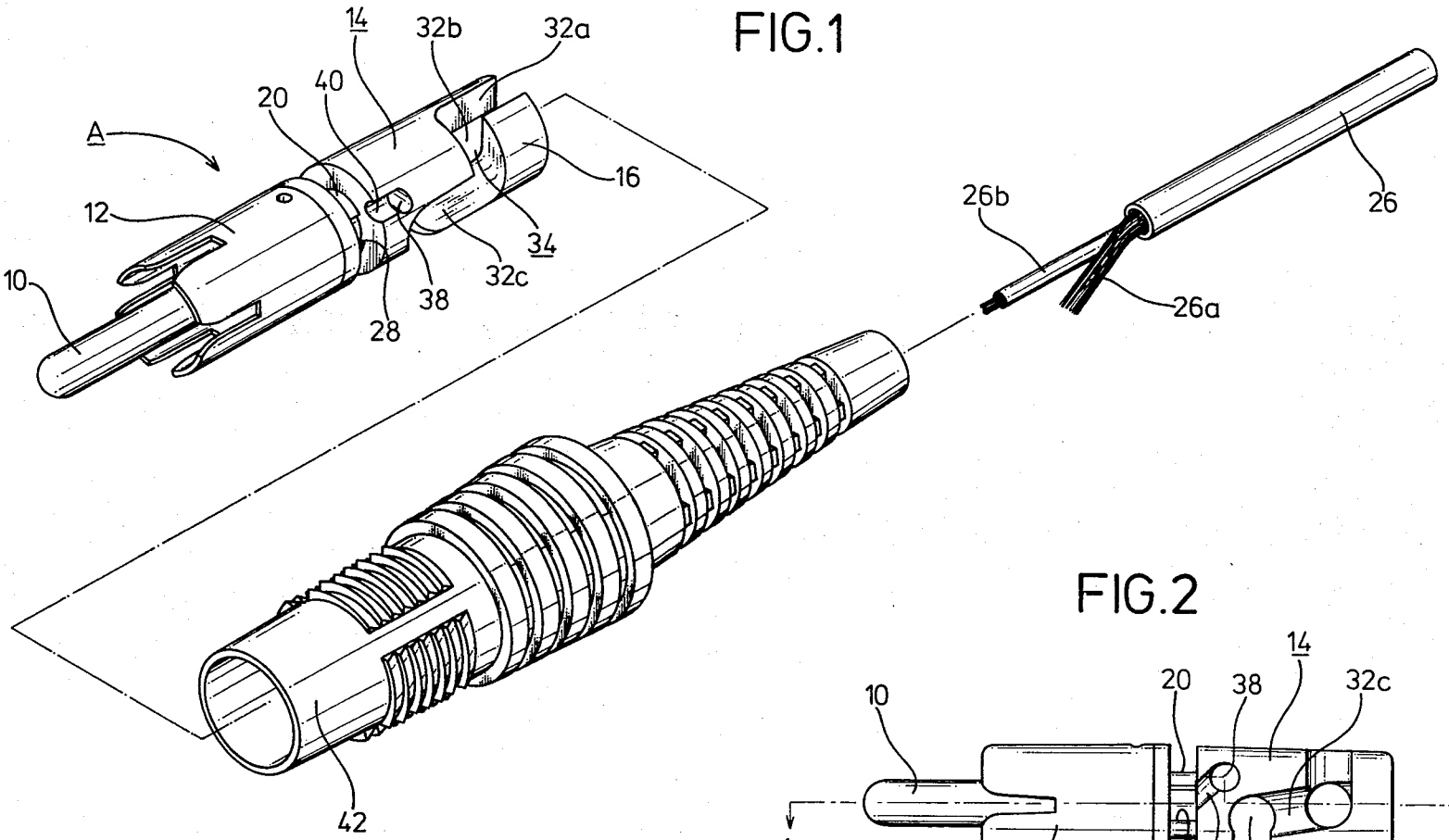
FIG. 1 is an exploded perspective view of the pin plug in accordance with the present invention.
Figure 2:
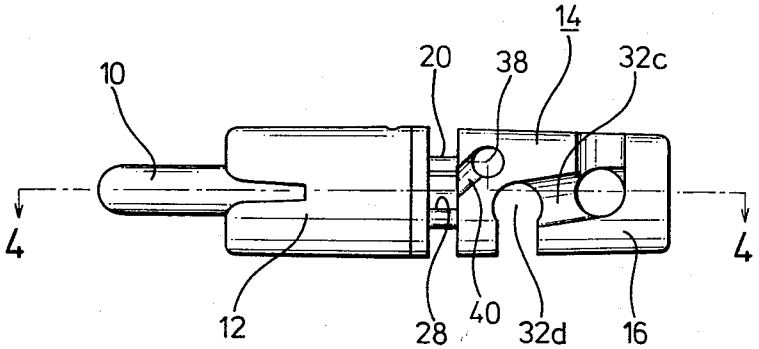
FIG. 2 is a front elevation of the plug body.
Figure 3:
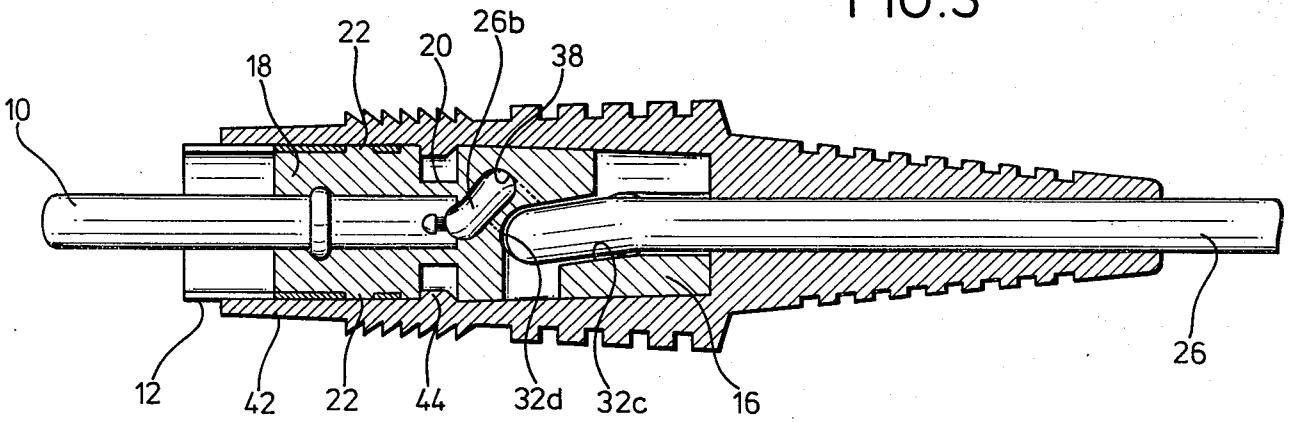
FIG. 3 is a longitudinally sectioned view of the plug body of FIG. 2 with a sleeve and a connecting cord.
Figure 4:
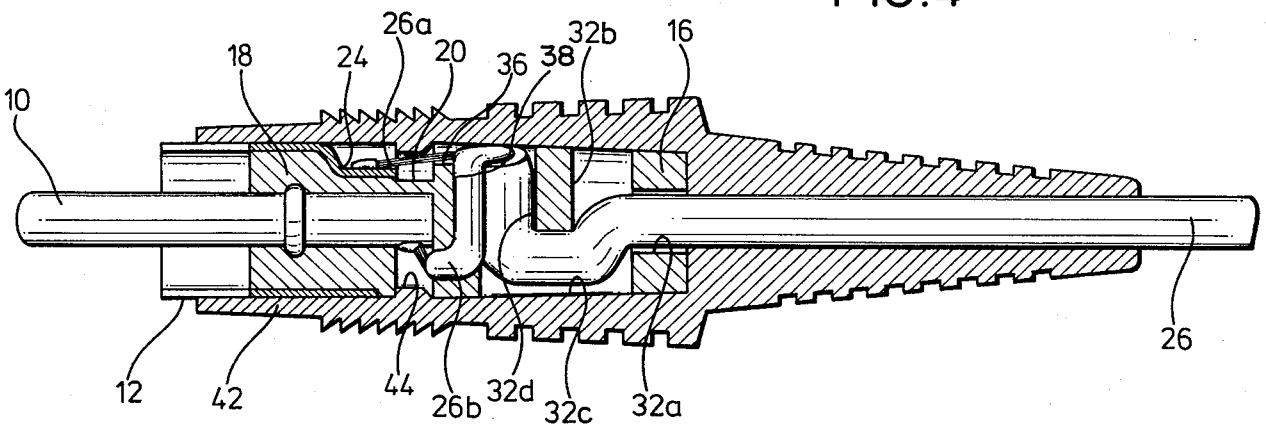
FIG. 4 is a longitudinally sectioned view taken along the line 4—4 of FIG. 2 with the sleeve and the connecting cord.

Referring now to the drawing wherein like reference character refer to like part a pin plug in accordance with the instant invention is shown at A in FIG. 1.

The pin plug body A is generally comprised of a rod electrode 10 and a cylindrical cap electrode 12 encircling coaxially the rod electrode 10 and a base body 14 for supporting the rod electrode 10 and the cap electrode 12.

The base body 14 is composed of insulating material and includes a body section 16 and a head section 18 connected therewith through a stem 20 and through the head section 18 is passed the rod electrode 10 whereas the cap electrode 12 is mounted around the head section 18 with projections 22 and thus electrically insulated from the rod electrode 10. In the circumference of the head section 18 is provided a recess 24 in which a terminal end portion of the cap electrode 12 is connected with a lead wire **26*a* of a connecting cord 26**.

In the circumference of the stem 20 is formed a window 28 to expose a part of the rod electrode 10 passing through the stem 20 for connection with a lead wire **26*b* of the connecting cord 26**.

In the circumference of the body section 16, there are provided in continuation an axial groove **32*a*, a radial groove 32*b*, an axial groove 32*c* and a radial groove 32*d* to form a single continuous groove of substantially Z-shape in which the connecting cord 26 is tightly received in rigid contact with the corners of the Z-groove 34 as hereinafter fully described. The lead wire 26*a* is connected to the terminal of the cap electrode 12 through a channel 36 provided in an end of the body section 16 in continuation with the radial groove 32*d*. While, the lead wire 26*b* is connected through an aperture 38 provided in the end portion of the body section 16 in parallel with the radial groove 32*d* and a short groove 40 in communication with the aperture 38 to the rod electrode 10 exposed through the window 28**.

The lead wires **26*a* and 26*b* are preferably connected to the electrodes 10 and 12 at symmetrical positions across the bar electrode 10** to avoid undesired occurance of short circuit.

In assembly of the attachment plug according to the invention, the rod electrode 10 and the cap electrode 12 are previously placed in a convenient metal mold and then the metal mold is filled with an insulating material such as plastics to form the base body 14 and finally the connecting cord 26 is guided through the Z-shape groove 34 in tight contact with each corner of the Z-groove 34.

The reference numeral 42 stands for a flexible sleeve which is generally made of insulating soft plastics or rubbers and adapted to coat the base body 14 with the cap electrode 12.

In inner circumferential wall of the sleeve 42 there is provided an annular ridge 44 which falls in a space formed between the head section 18 and the body section 16. It will be appreciated that the sleeve 42 is constituted removable from the base body 14 for convenient checking of accident to be caused and repair thereof.

Further, as compared with the conventional structure here even when the connecting cord and the electrodes 10 and 12 are molded together, the molding is performed at more reduced time without entailing any likelihood of melting the connecting cord 26 due to an avoidance of elevated temperature under an extended molding operation.

As hereinbefore described, the radial groove **32*d* is provided in normal to the length of the pin plug and passing through the base body. Accordingly, the connecting cord 26 is tightly received in the groove 34 in a zig-zag form on account of the presence of the radial grooves, so that any separation or disengagement of the connecting cord 26 may be perfectly prevented, because a tension generated when the connecting cord 26** is drawn is absorbed in the corners of the Z-groove and can not reach at the connecting part of the electrode with the connecting cord.

As hereinbefore fully described, the pin plug according to the invention has an improved durability even with a simple structure which is convenient for mass production.

Without further elaboration, the foregoing will so fully illustrate my invention that others may, by applying the current or future knowledge, readily adapt the same for use under various conditions of service.

What is claimed is:

1. A pin plug for attachment to the lead wire of a connecting cord comprising a bar electrode and a cap electrode and a base for holding said bar electrode and said cap electrode coaxially and insulatedly from each other and a flexible sleeve for coating said base, said base including a head section for supporting said cap and bar electrodes and a body section provided in its circumference with at least one continuous groove for receiving the lead wires of a connecting cord, said continuous groove comprising at least three tandemly arranged groove portions, at least one of said groove portions extending axially and one of said groove portions extending radially of said base, said axial and radial groove portions alternating with each other, said base being formed with an annular space between said head and body sections for connection of one of said lead wires to said cap electrode and a stem portion coupling said head and body sections, and through which said bar electrode extends for connection of the other lead wire and at least one hole in communication with the last radial groove for passing the lead wire to said stem portion to be connected to the bar electrode.

2. A pin plug as claimed in claim 1, wherein the stem portion is provided with a window to expose the bar electrode for connection with the lead wire derived from the connecting cord.

3. A pin plug as claimed in claim 1, wherein the cap electrode is provided with a recess for receiving a terminal end of the lead wire to be connected therewith.

4. A pin plug as claimed in claim 1, wherein the flexible sleeve is provided in its circumferential wall with an annular ridge which is adapted to be received in the annular space formed between the head section and the body section.

5. A pin plug as claimed in claim 1, wherein the marginal edge portion of the base body is provided with a recess in communication with the last radial groove for receiving another lead wire to be connected to the cap electrode.

* * * * *